US010222034B2

(12) United States Patent
Friederichs et al.

(10) Patent No.: US 10,222,034 B2
(45) Date of Patent: Mar. 5, 2019

(54) LIGHTING DEVICE HAVING LOCKING MECHANISM WITH HOOK AND RESILIENT FINGER ELEMENTS

(71) Applicant: PHILIPS LIGHTING HOLDING B.V., Eindhoven (NL)

(72) Inventors: Winand Hendrik Anna Maria Friederichs, Eindhoven (NL); Vincent Stefan David Gielen, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/567,259

(22) PCT Filed: Apr. 12, 2016

(86) PCT No.: PCT/EP2016/058028
§ 371 (c)(1),
(2) Date: Oct. 17, 2017

(87) PCT Pub. No.: WO2016/173834
PCT Pub. Date: Nov. 3, 2016

(65) Prior Publication Data

US 2018/0106464 A1 Apr. 19, 2018

(30) Foreign Application Priority Data

Apr. 28, 2015 (EP) ..... 15165331

(51) Int. Cl.

| | |
|---|---|
| ***F21V 17/10*** | (2006.01) |
| ***F21V 19/00*** | (2006.01) |
| ***F21K 9/90*** | (2016.01) |
| ***F21K 9/232*** | (2016.01) |
| ***F21V 29/65*** | (2015.01) |
| ***F21V 29/75*** | (2015.01) |
| ***F21V 29/85*** | (2015.01) |

(Continued)

(52) U.S. Cl.
CPC ..... *F21V 19/003* (2013.01); *F21K 9/232* (2016.08); *F21K 9/90* (2013.01); *F21V 19/004* (2013.01);

(Continued)

(58) Field of Classification Search
CPC ..... F21V 17/104; F21V 17/10; F21V 17/04; F21V 21/088; F21V 21/0885; F21K 9/232; F21K 9/235; F16L 3/1211
See application file for complete search history.

(56) References Cited

U.S. PATENT DOCUMENTS 1,394,529 A * 10/1921 Armitage ..... F16B 2/12 248/231.41
1,452,977 A * 4/1923 Medeiros ..... F21V 21/0885 248/229.2

(Continued)

FOREIGN PATENT DOCUMENTS

| | | |
|---|---|---|
| CN | 203115641 U | 8/2013 |
| CN | 203223799 U | 10/2013 |
| EP | 2505914 A1 | 10/2012 |

*Primary Examiner* — Ismael Negron
(74) *Attorney, Agent, or Firm* — Akarsh P. Belagodu

(57) ABSTRACT

A lighting device includes an envelope; a light generating unit with at least one solid state light source; a stem configured to support the light generating unit inside the envelope and including an indent; a mechanical fastening part configured to fasten the light generating unit to the stem and including a hook element to mate with the indent and at least one finger to abut the stem; and a locking mechanism configured to lock the mechanical fastening part to the stem by preventing deflection of the hook element and at least one finger.

18 Claims, 10 Drawing Sheets

(51) Int. Cl.
*F21Y 101/00* (2016.01)
*F21Y 115/10* (2016.01)
*F21Y 107/30* (2016.01)

(52) U.S. Cl.
CPC ..... *F21V 29/65* (2015.01); *F21V 29/75* (2015.01); *F21V 29/85* (2015.01); *F21Y 2101/00* (2013.01); *F21Y 2107/30* (2016.08); *F21Y 2115/10* (2016.08)

(56) References Cited

U.S. PATENT DOCUMENTS 5,448,459 A * 9/1995 Rogers ..... B43K 29/10 362/118
5,890,794 A * 4/1999 Abtahi ..... B60Q 7/00 362/294
7,810,968 B1 * 10/2010 Walker ..... F21V 21/30 362/431
8,197,091 B1 * 6/2012 Kyle ..... F21S 8/088 362/249.06
8,591,062 B2 * 11/2013 Hussell ..... F21V 7/00 362/249.01
8,680,754 B2 * 3/2014 Premysler ..... F21V 3/02 313/46
9,416,922 B1 * 8/2016 Stagni ..... H05B 33/0845
9,851,055 B2 * 12/2017 Gielen ..... F21K 9/232
9,951,910 B2 * 4/2018 Reier ..... F21K 9/23
2013/0271989 A1 10/2013 Hussell et al.
2014/0036497 A1 2/2014 Hussell et al.
2014/0340913 A1 * 11/2014 Cui ..... F21V 29/006 362/382
2018/0106434 A1 * 4/2018 Gao ..... F21V 29/70

* cited by examiner

LIGHTING DEVICE HAVING LOCKING MECHANISM WITH HOOK AND RESILIENT FINGER ELEMENTS

CROSS-REFERENCE TO PRIOR APPLICATIONS

This application is the U.S. National Phase application under 35 U.S.C. § 371 of International Application No. PCT/EP2016/058023, filed on Apr. 12, 2016, which claims the benefit of European Patent Application No. 15165331.8, filed on Apr. 28, 2015. These applications are hereby incorporated by reference herein.

TECHNICAL FIELD OF THE INVENTION

The present invention relates to lighting devices comprising solid state light sources. Further, the present invention relates a lighting device comprising a locking mechanism and to methods for manufacturing such a lighting device.

BACKGROUND

Traditional incandescent lighting devices are currently being replaced by more energy efficient alternatives, such as halogen lighting devices and light emitting diode, LED, lighting devices. When designing new lighting devices, it is desirable to resemble the traditional design of incandescent lighting devices in order to enable use of existing manufacturing equipment.

In traditional incandescent light bulbs, a tungsten filament is normally supported in a glass envelope by means of a glass stem. An LED bulb comprising a substrate, an LED, and an LED driving plate welded above the substrate is shown in CN 203115641 U. The driving plate is connected with a steel needle in the middle of the core column through a chuck, which may provide inadequate fixation of the driving plate to the core column. The air flow of the LED bulb shown in CN 203115641 U will be blocked since the driving plate is mounted directly to the substrate. Further, the driver components are mounted within the LED bulb and will outgas and may consume oxygen which reduces the light output from the LEDs.

In US2013/0271989 a lamp is disclosed with an LED array disposed in an optically transmissive enclosure. A gas, e.g. oxygen or helium, is contained in said enclosure for transporting the heat from the LEDs to the enclosure. The LED array is supported by a stem-like structure.

Further, US2014/0036497 describes a retrofit type of lamp with a LED module and a heat sink and a reflector which is thermally coupled to the heat sink such that the heat is at least partially dissipated to the ambient through the reflector.

SUMMARY

It would be advantageous to provide a lighting device and a method of manufacturing a lighting device overcoming, or at least alleviating, the above mentioned drawbacks.

According to a first aspect of the present invention, this and other objectives are achieved by a lighting device comprising an envelope, a light generating unit comprising at least one solid state light source, a stem arranged to support the light generating unit inside the envelope, a mechanical fastening part arranged to fasten the light generating unit at the stem, and a locking mechanism arranged to lock the mechanical fastening part to the stem.

The present invention is based on the realization that the mechanical fastening part can be further secured to the stem by the use of the locking mechanism arranged to lock the mechanical fastening part to the stem. Thereby, it is further ensured that the mechanical fastening part and the light generating unit will stay attached to the stem during handling of the lighting device for manufacturing, transport or by a customer. Thus, the present invention provides a sturdier lighting device with an improved tolerance to handling.

The mechanical fastening part may comprise a hook element arranged to mate with an indent of the stem and at least one finger element arranged to abut against the stem. The locking mechanism may be adapted to prevent deflection of at least one of the hook element and the at least one finger element of the mechanical fastening part.

The locking mechanism may comprise an opening that at least partly fits around the stem. In various embodiments of the inventions, the opening may be formed by a circular hole through the locking mechanism, which circular hole fits around the stem. The stem may thus be received in the opening of the locking mechanism, and the locking mechanism at least partly fits around the stem.

The locking mechanism may be configured to be snapped onto the mechanical fastening part in order to be fastened to the mechanical fastening part.

The locking mechanism may comprise at least one first locking leg extending substantially parallel to the stem and adapted to prevent the at least one finger element of the mechanical fastening part from deflecting in at least one direction.

In various exemplary embodiments, the mechanical fastening part may comprise two finger elements. The locking device may then be adapted to prevent deflection of both the finger elements. For example, the locking device may comprise two or more first locking legs, namely at least one first locking leg for each finger element of the mechanical fastening part, so that both finger elements may be blocked or prevented from being deflected, to further prevent the mechanical fastening part from coming loose.

The locking mechanism may comprise at least one second locking leg adapted to prevent the hook element of the mechanical fastening part from un-mating with the indent of the stem.

In one embodiment of the invention, the locking mechanism may comprise a ring formed around said circular hole, and wherein said at least one first and second locking legs are distributed about the circumference of the ring.

The at least one first locking leg may comprise a snap feature adapted to snap onto the at least one finger element of the mechanical fastening part, and the locking ring may comprise at least one surface situated between the at least one first locking leg and the at least one second locking leg and adapted to abut against the hook element of the mechanical fastening part, to axially secure the locking mechanism to the mechanical fastening part.

In another embodiment of the invention, the locking mechanism may comprise a central portion including the circular hole, a first portion bent relative to the central portion and including the at least one first locking leg, and a second portion bent relative to the central portion and including the at least one second locking leg in the form of at least one spring adapted to engage with the hook element of the mechanical fastening part for preventing the hook element of the mechanical fastening part from un-mating with the indent of the stem and for snapping the locking mechanism onto the mechanical fastening part.

Further, each at least one first locking leg may be a pair of first locking legs adapted to prevent the at least one finger element of the mechanical fastening part from deflecting in two directions. By preventing the at least one finger from deflecting in two direction, the mechanical fastening part may be additionally secured to the stem.

In one embodiment of the invention, the locking mechanism may be U-shaped with first and second parallel sections and an intermediate curved section, wherein the opening may be formed by a recess in the first and the second sections. The first and the second section may each comprise two prongs formed by the recess, and each prong of the first section includes the at least one first locking leg.

Further, each prong with the at least one first locking leg may further serve to radially snap the locking mechanism onto the mechanical fastening part.

Furthermore, each prong of the second section may comprise a skid-shaped member adapted to secure the locking mechanism to the mechanical fastening part.

Moreover, each prong of the second section may comprise a snap feature adapted to secure the locking mechanism to the mechanical fastening part.

According to a second aspect of the present invention, the objectives are also at least partly achieved by a method for manufacturing a lighting device according to the first aspect. The method comprises locking the mechanical fastening part to the stem using the locking mechanism.

This aspect of the invention may exhibit the same or similar features and/or technical effects as the first aspect.

In one embodiment of the invention, the method may further comprise mounting the mechanical fastening part radially to the stem. Locking the mechanical fastening part to the stem using the locking mechanism may comprise placing the locking mechanism axially onto the mechanical fastening part.

In another embodiment of the invention, the method may further comprise mounting the locking mechanism to the mechanical fastening part. Locking the mechanical fastening part to the stem using the locking mechanism may comprise mounting the mechanical fastening part with the locking mechanism radially to the stem.

Further features of, and advantages with, the present invention will become apparent when studying the appended claims and the following description. The skilled person realizes that different features of the present invention may be combined to create embodiments other than those described in the following, without departing from the scope of the present invention.

BRIEF DESCRIPTION OF THE DRAWINGS

These and other aspects of the present invention will now be described in more detail, with reference to the appended drawings showing different embodiments of the invention.

All the figures are schematic, not necessarily to scale, and generally only show parts which are necessary in order to elucidate the embodiments, wherein other parts may be omitted or merely suggested. Like reference numerals refer to like elements throughout the description.

DETAILED DESCRIPTION OF THE DRAWINGS

In the present detailed description, embodiments of a lighting device according to the present invention are mainly discussed with reference to schematic views showing a mechanical fastening part, a stem and a locking mechanism according to different embodiments of the invention. It should be noted that this by no means limit the scope of the invention, which is also applicable in other circumstances for instance with other types or variants of lighting devices, mechanical fastening parts or stems than the embodiments shown in the appended drawings. Further, that specific components are mentioned in connection to an embodiment of the invention does not mean that those components cannot be used to an advantage together with other embodiments of the invention. The invention will now be described with reference to the enclosed drawings where first attention will be drawn to the structure, and then secondly the function.

Figure 1:
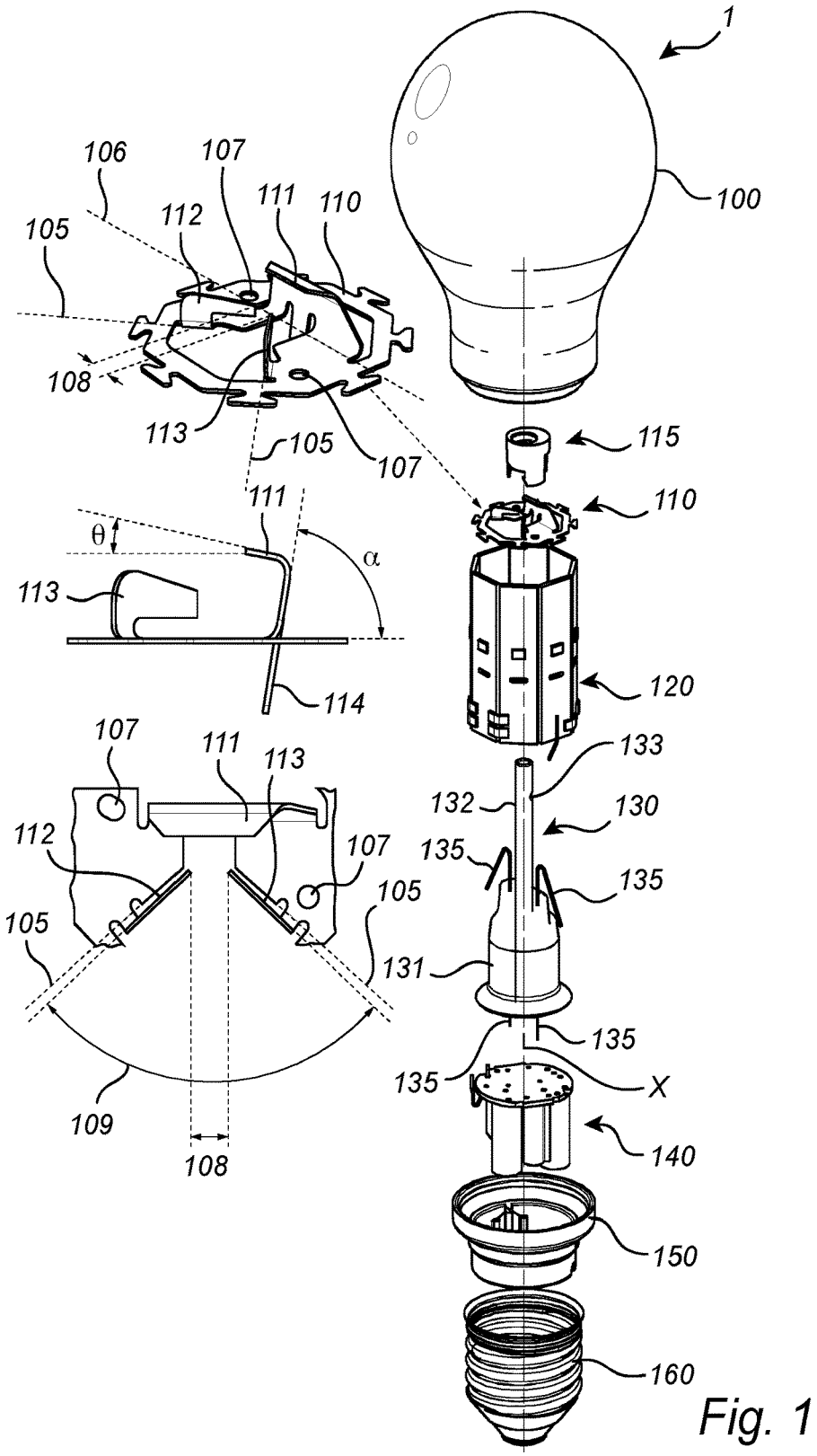
FIG. 1 is an exploded view of a lighting device according to one embodiment of the invention.

FIG. 1 shows an exploded view of a lighting device 1 according to an embodiment of the invention. It will be appreciated that the examples of various features of the lighting device 1 described with reference to FIG. 1 are combinable with other embodiments described hereinafter with reference to the appended drawings.

The lighting device 1 may for example be a lamp or a light bulb. The lighting device 1 may comprise an envelope 100, e.g. shaped as a bulb, a light generating unit 120, a stem 130 arranged to support the light generating unit in the envelope 100 and a mechanical fastening part 110 arranged to fasten the light generating unit 120 to the stem 130. The lighting device 1 may have an optical axis X. The stem 130 may extend along the optical axis X of the lighting device 1. The stem 130 may be light transmissive. For example, the stem 130 may be made of glass or any other transparent or translucent material. Optionally, the stem 130 may comprise a base portion 131 and a pump tube portion 132 having a smaller diameter than the base portion 131. The stem comprises an indent 133. The indent 133 may not necessarily extend circumferentially around the whole stem 130, but merely at one side of the stem 130. Wires 135 may be arranged at the stem 130 for electrically connecting the light generating unit 120 to a driver 140 of the lighting device 1. The lighting device 1 may further comprise a cap 160 for electrically connecting the driver 140 to a power supply. For example, the cap 160 may be a screw base. The cap 160 may be arranged at the lower end of the stem 130. The lighting device 1 may further comprise an isolation part 150 arranged to electrically isolate the driver 140 from the cap 160.

The envelope 100 is understood to be light transmissive. For example, the envelope 100 can be made of glass. The envelope 100 may be filled with a Helium-Oxygen mixture. In lighting devices with such a gas mixture, the internal thermal resistance may be relatively high. Therefore, the light generating unit 120 may preferably have a chimney-like shape, so as to function as a thermal chimney, which enhances heat dissipation from the light generating unit 120. For example, the light generating unit 120 may comprise one or more carriers arranged around the stem 130 so as to form a chimney-like structure. The one or more carriers may e.g. be one or more circuit boards, such as one or more printed circuit boards, PCBs. The carriers may be interconnected by means of connecting elements. One or more solid state light sources may be arranged on the one or more carriers. For example, the solid state light sources may be light emitting diodes (LED), OLEDs, PLEDs, laser diodes or the like.

The mechanical fastening part 110 may comprise one or more protrusions and the light generating unit 120 may comprise one or more holes adapted to mate with the protrusions so as to fasten the light generating unit to the mechanical fastening part 110. For example, the holes may be located in the one or more carriers. The protrusions may e.g. extend through the holes of the light generating unit 120, such that the light generating unit 120 is supported by the protrusions. Further, the protrusions may be slightly deformed, such as bent or twisted, so as to reduce the risk of the light generating unit 120 coming off the protrusions and to reduce possible movement between the light generating unit 120 and the stem 130.

The mechanical fastening part 110 may be formed by a single piece of material, such as metal. Preferably, the mechanical fastening part 110 may be formed by a piece of non-oxidizing sheet metal, e.g. stainless steel. This allows for a sufficiently strong and stiff support of the light generating unit, whilst preventing lumen decay in the LEDs by oxidation of the mechanical fastening part 110 and decrease of thermal performance by outgassing (i.e. as is the case with polymers) of the mechanical fastening part 110. The desired shape of the mechanical fastening part 110 may e.g. be achieved by cutting, folding and/or deep drawing. For example, the metal sheet may be cut such that the rim of the metal sheet forms the protrusions. As is shown in the enlarged views, the mechanical fastening part 110 comprises a hook element 111, and at least one finger element, here shown as two finger elements 112, 113. The hook element 111 is arranged to mate with the indent 133 of the stem 130. The two finger elements 112, 113 are arranged to abut against the stem 130.

The mechanical fastening part 110 may for example be cut such that portions form the finger elements 112, 113 and the hook element 111. Each portion forming the respective finger element 112, 113 is then bent about 90 degrees relative to the rest of the mechanical fastening part 110, across its respective bending line 105, to form the upstanding finger elements 112, 113 shown in the appended drawings. The finger elements 112, 113 are separated by an insertion angle 109. The insertion angle 109 may be 0-180 degrees, preferably about 90 degrees, or 90-135 degrees. The ends of the finger elements 112, 113 are separated from each other by a finger distance 108. The finger distance 108 is smaller than the diameter of the stem 130. The portion forming the hook element 111 is bent across the bending line 106. The entire hook element 111 is bent an angle $\alpha$. The angle $\alpha$ may be 0-90 degrees. The end of the hook element 111, a flange that mates with the indent 133 of the stem 130, is bent about 90 degrees relative to the rest of the hook element 111 to form an insertion angle $\theta$ to the indent 133. The insertion angle $\theta$, and thus the bending of the flange, may be adapted such that the hook element 111 correctly mates with the indent 133 of the stem 130. The hook element 111 further comprises a tail portion 114, at the opposite end of the flange, which is adapted to abut the stem 130.

During assembly or manufacturing, inserting the stem 130 into the center position of the mechanical fastening part 110 may for example comprise inserting the stem 130 through the mechanical fastening part 110, and pushing the stem 130 towards the center position. The stem 130 is guided by the finger elements 112, 113 due to the insertion angle 109, and at least one of the finger elements 112, 113 deflects as the finger distance 108 is smaller than the diameter of the stem 130. As the stem passes the respective ends of the finger elements 112, 113, the finger elements 112, 113 snap back and abut the stem 130. The hook element 111, in particular the flange, mates with the indent 133 of the stem 130, and the tail portion 114 abuts the stem 130. It should be understood that the flange and the tail portion contacts the stem 130, each of them will force the other into contact as the first one abuts the stem and forces the hook element 111 to rotate about the bending line 106.

The mechanical fastening part 110 further comprises holes 107 arranged for facilitating fixing the mechanical fastening part 110 in e.g. an assembly tool or for manipulating the mechanical fastening part 110 during manufacturing.

In the embodiments described there are two finger elements 112, 113. It should be noted that it is possible and within the scope of the present invention that the mechanical fastening part 110 comprises just one finger element, or more than two finger elements.

Further details and/or illustrations of embodiments and variations of the mechanical fastening part 110, the light generating unit 120, the stem 130, and how they fasten to each other to e.g. manufacture a lighting device are described in the co-pending European patent application no. 14196703.4 by the same applicant and entitled "Lighting device with mechanical fastening part", the contents of which herein is incorporated by reference.

The lighting device 1 further comprises a locking mechanism 115. The locking mechanism 115 is mechanical. The locking mechanism is arranged to lock the mechanical fastening part 110 to the stem 130, in particular to the pump tube portion 132 of the stem 130. The locking mechanism 115 further secures the mechanical fastening part 110 to the stem 130 by being adapted to prevent deflection of at least one of the hook element 111 and the two finger elements 112, 113 of the mechanical fastening part 110. The locking mechanism 115 shown in FIG. 1 corresponds to the embodiment of a locking mechanism shown in FIGS. 2*a-d*, but the embodiments of a locking mechanism shown in FIGS. 3*a-d* or FIGS. 4*a-k* could likewise be used to advantage with the lighting device 1.

In use, the lighting device 1 provides lighting by the at least one solid state light source of the light generating unit 120 which emits light. The lighting device 1 is mounted to e.g. a socket via the cap 160 and thereby connected to e.g. mains electricity or any other power supply, the driver 140 typically converts the AC current found in mains electricity to DC current suitable for solid state light sources.

In the following, locking mechanisms according to various embodiments of the present invention will be described in more detail. The mechanical fastening part 110 and stem 130 according to the embodiments described in the following may in general be similarly configured as the mechanical fastening part 110 and the stem 130 as described with reference to FIG. 1. Other types of mechanical fastening parts 110 and other stems or configurations of the stem 130 may also be possible to use to advantage with the functionality or features of the locking mechanisms described hereinafter.

Figure 2A:
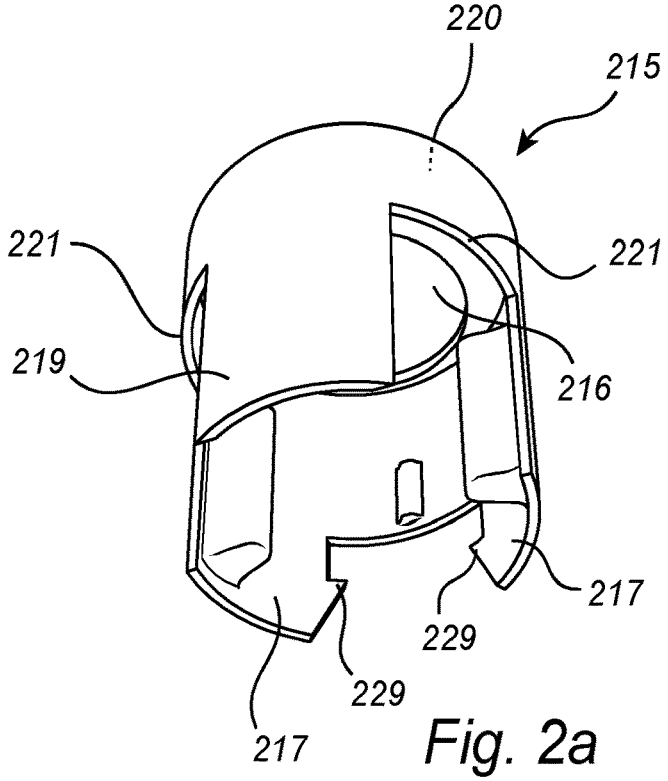
FIG. 2*a* is a perspective view of a locking mechanism for a lighting device according to one embodiment of the invention.

FIG. 2*a* shows a perspective view of a locking mechanism 215 according to one embodiment of the invention. The locking mechanism 215 comprises an opening formed by a circular hole 216 through the locking mechanism 215. The circular hole 216 fits around the stem 130, in particular around the pump tube portion 132 of the stem 130. The locking mechanism 215 comprises a ring 220 formed around the circular hole 216, and two first 217 locking leg and a second locking leg 219 distributed about the circumference of the ring 220. Each first locking leg 217 extend substantially parallel to the stem 130 and is adapted to prevent the respective finger element 112, 113 from deflecting in a direction indicated by reference sign Y in FIG. 2*d*. The second locking leg 219 extends substantially parallel to the stem 130 and is adapted to prevent the hook element 111 of the mechanical fastening part 110 from un-mating with the indent 133 of the stem 130.

Each first locking leg 219 comprises a snap feature 229 adapted to snap onto the respective finger element 112, 113 of the mechanical fastening part 110. Further, the locking ring 220 comprises two surfaces 221. One of the surfaces 221 is situated between one of the first locking legs 217 and the second locking leg 219, and the other surface 221 is situated between the other first locking leg 217 and the second locking leg 219. The two surfaces 221 are adapted to abut against the hook element 111 of the mechanical fastening part 110.

Figure 2B:
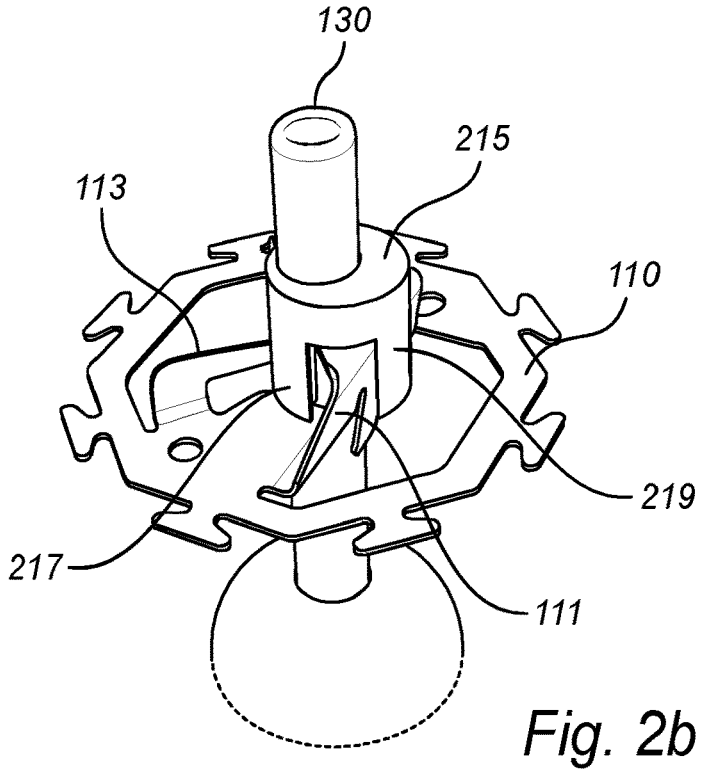
FIGS. 2*b-d* are perspective views of a mechanical fastening part, stem and locking mechanism of the embodiment shown in FIG. 2*a;*
Figure 2C:
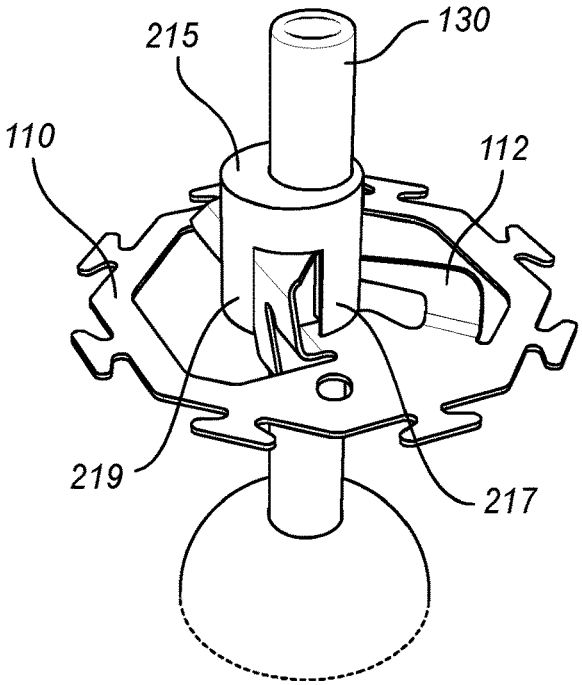
Figure 2D:
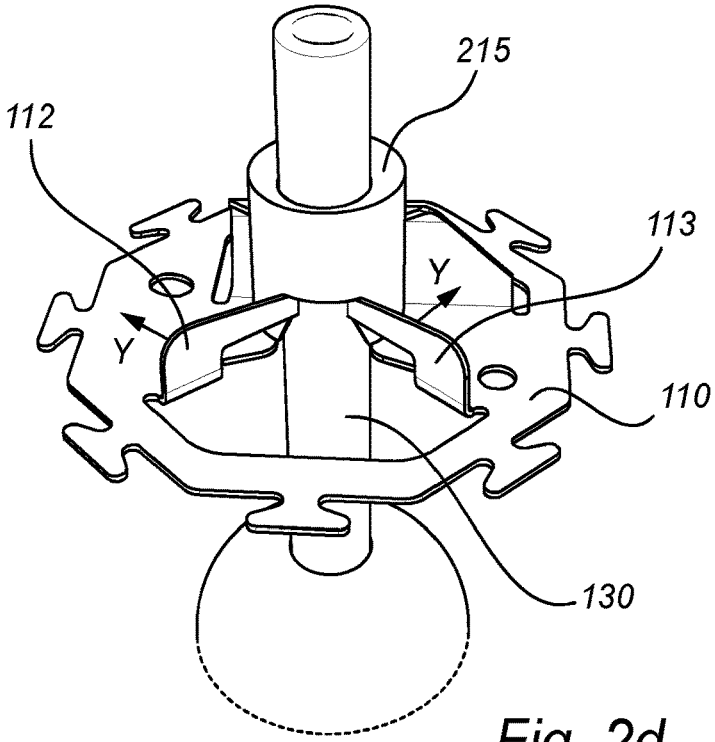

The locking mechanism 215 may be snapped onto the mechanical fastening part 110 as shown in FIG. 2*b-d* which are perspective views of a mechanical fastening part 110, the pump tube portion 132 of the stem 130 and the locking mechanism 215. The snap feature 229 and the two surfaces 221 then axially secure the locking mechanism 215 to the mechanical fastening part 110. With the locking mechanism snapped onto the mechanical fastening part 110, the second locking leg 219 prevents the hook element 111 from unmating with the indent 133 of the stem 130 and the two first locking legs 217 prevents the finger elements 112, 113 from deflecting away from the stem 130.

The locking mechanism 215 may for example be deep drawn from sheet metal into the shape of the locking mechanism 215. It should be noted that other alternatives for manufacturing the locking mechanism 215 are of course possible, for example 3D printing the locking mechanism 215, or using other materials such as thermoplastic or other suitable materials which can be formed into the corresponding shape and then be deformed to snap onto the mechanical fastening part 110.

Figure 3A:
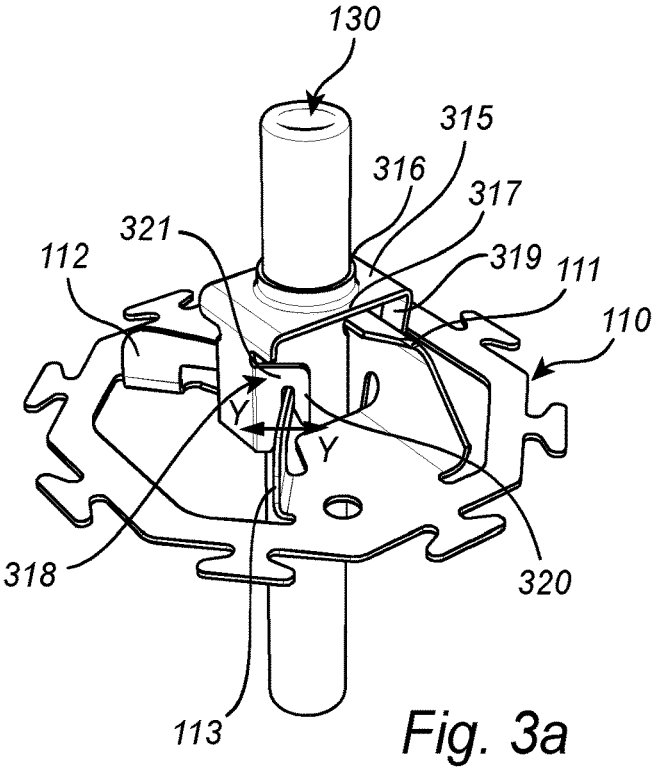
FIG. 3*a* is a perspective view of a mechanical fastening part, stem and locking mechanism for a lighting device according to another embodiment of the invention.
Figure 3B:
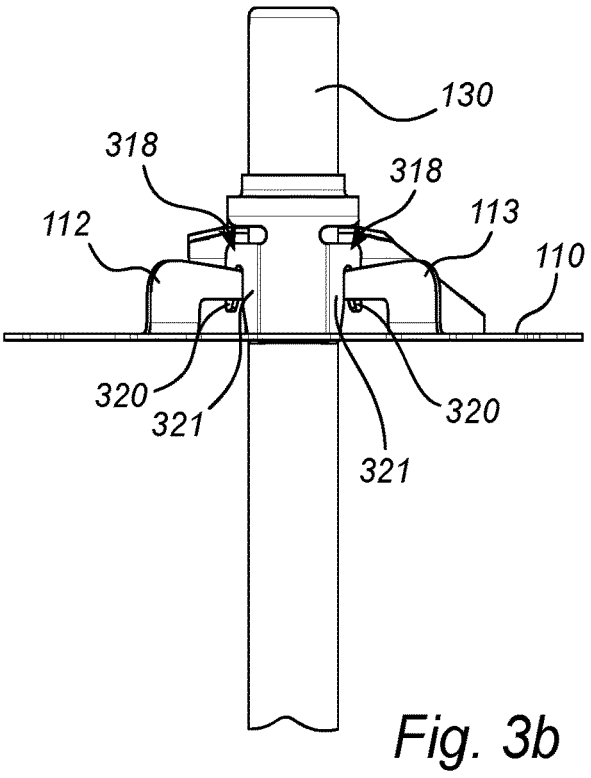
FIGS. 3*b-d* are side views of a mechanical fastening part, stem and locking mechanism for a lighting device according to the embodiment shown in FIG. 3*a*.
Figure 3C:
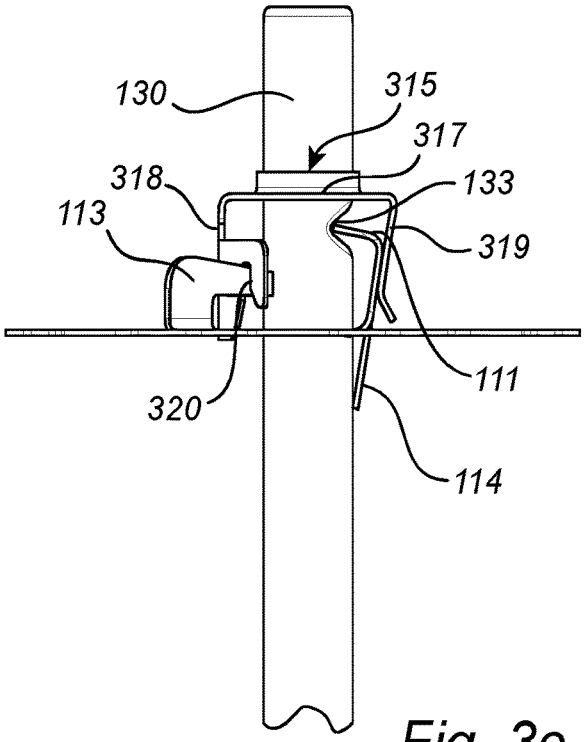
Figure 3D:
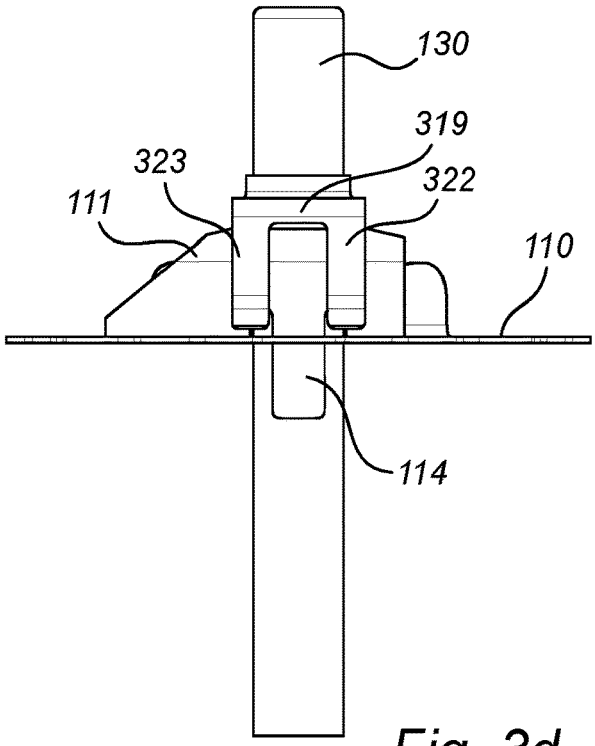

FIG. 3*a* is a perspective view of a mechanical fastening part 110, the pump tube portion 132 of the stem 130 and a locking mechanism 315 according to another embodiment of the invention. FIGS. 3*b-d* are side views of the mechanical fastening part 110, the pump tube portion 132 of the stem 130 and the locking mechanism 315 shown in FIG. 3*a*. FIGS. 3*a-d* show the locking mechanism 315 snapped onto the mechanical fastening part 110.

The locking mechanism 315 comprises a central portion 317, a first portion 318 generally bent about 90 degrees relative to the central portion 317, and a second portion 319 generally bent about 90 degrees relative to the central portion 317. The central portion comprises an opening 316 formed by a circular hole through the locking mechanism 315. The circular hole 316 fits around the stem 130, in particular around the pump tube portion 132 of the stem 130.

The first portion 318 includes two pairs of first locking legs 320, 321. Each pair of first locking legs 320, 321 is adapted to prevent the respective finger element 112, 113 from deflecting in two opposite directions indicated by reference signs Y, Y' in FIG. 3*a*.

Now referring to FIG. 3*d*, the second portion 319 comprises the second locking leg 319 in the form of two springs 322, 323. The springs 322, 323 are adapted to engage with the hook element 111 of the mechanical fastening part 110 for preventing the hook element 111 of the mechanical fastening part 110 from un-mating with the indent 133 of the stem 130. Further, the springs 322, 323 are adapted for snapping the locking mechanism 315 onto the mechanical fastening part 110. Hence, the springs 322, 323 serve at least two purposes for the locking mechanism 315. Note that the invention is not limited to two springs, there could be just one spring or more than two springs.

The locking mechanism 315 may be snapped onto the mechanical fastening part 110 as shown in FIG. 3*a-d*. The two springs 322, 323 together with the circular hole 316 with the received stem 130 then axially secures the locking mechanism 215 to the mechanical fastening part 110. With the locking mechanism 315 snapped onto the mechanical fastening part 110, the springs 322, 323 will prevent the hook element 111 from un-mating with the indent 133 of the stem 130 and the locking legs 320, 321 prevent the finger elements 112, 113 from deflecting away from the stem 130.

Figure 4A:
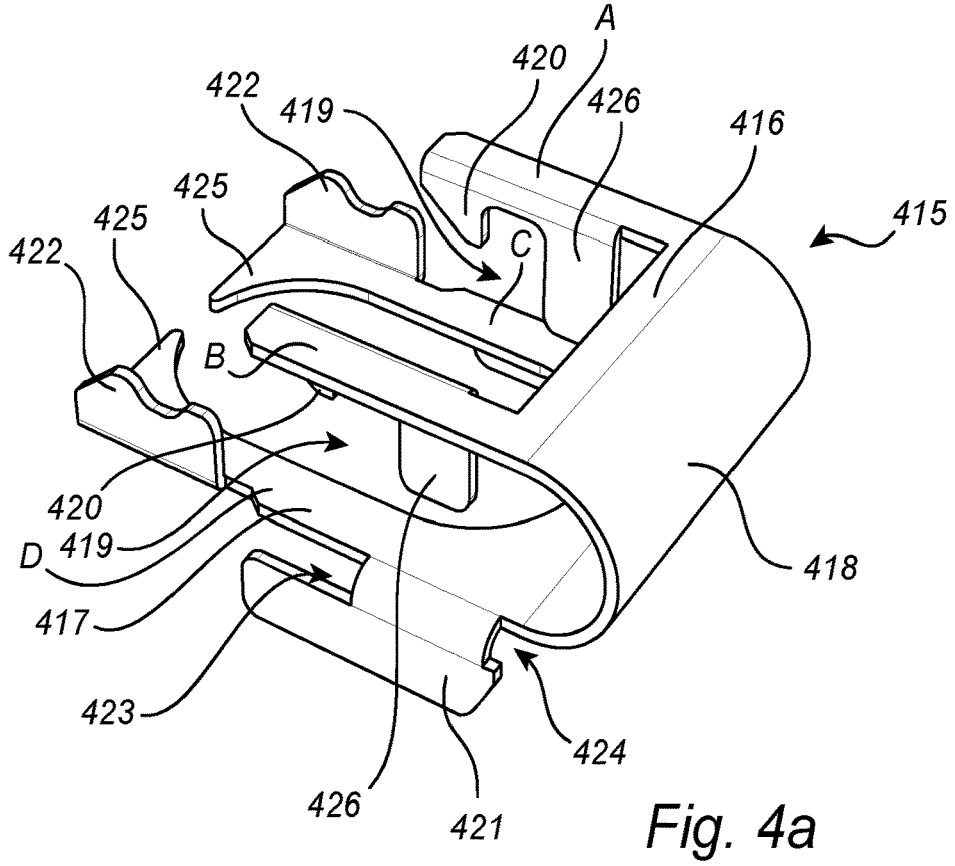
FIG. 4*a* is a perspective view of a locking mechanism for a lighting device according to another embodiment of the invention.
Figure 4B:
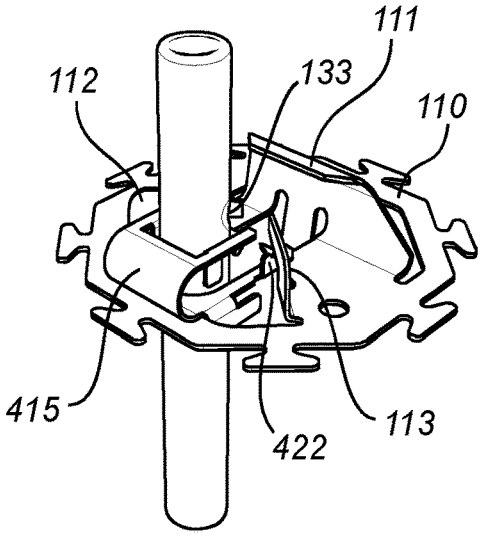
FIG. 4*b*-k are perspective, top and side views of a mechanical fastening part, stem and locking mechanism for a lighting device according to the embodiment shown in FIG. 4*a*.
Figure 4C:
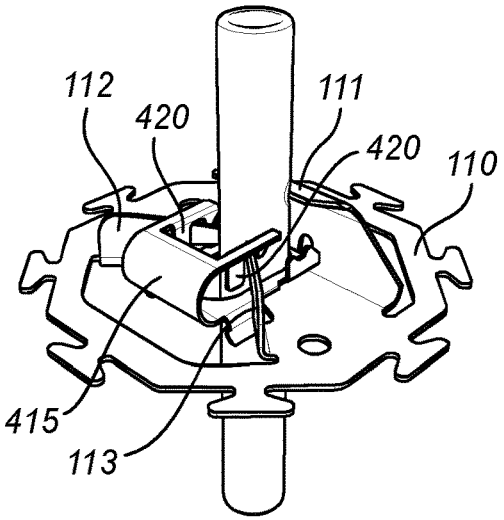
Figure 4D:
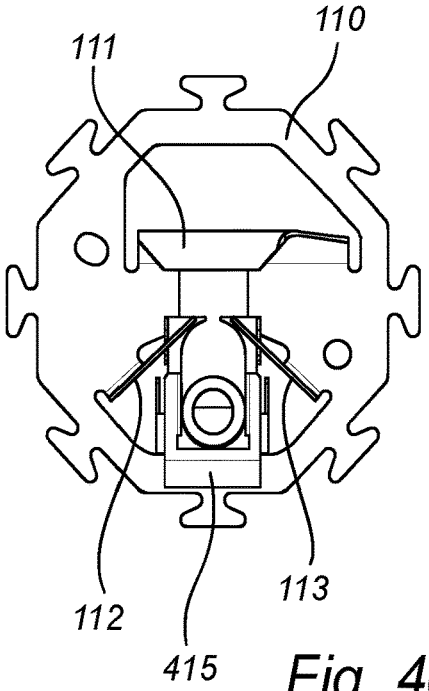
Figure 4E:
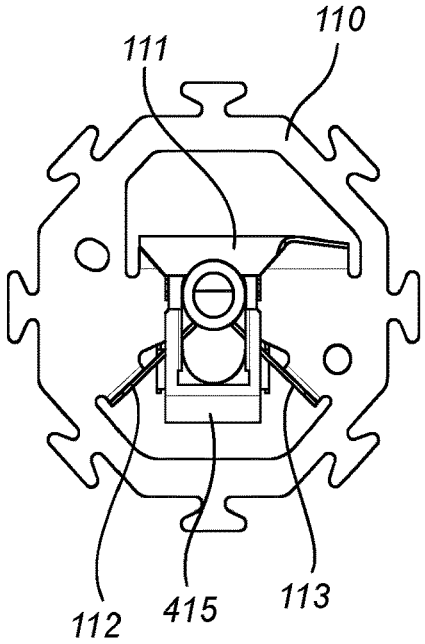
Figure 4F:
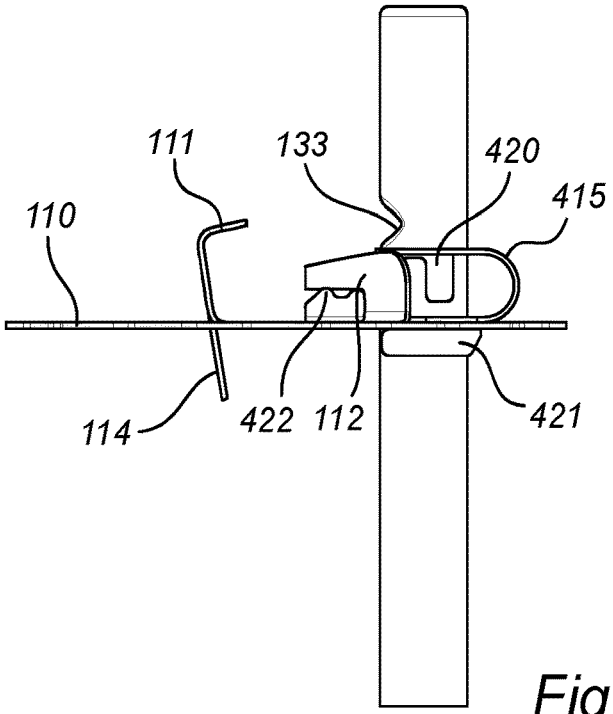
Figure 4G:
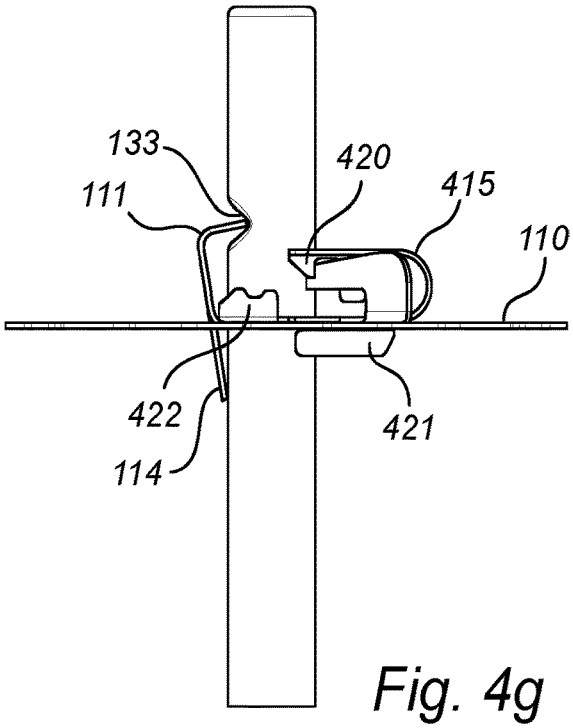
Figure 4H:
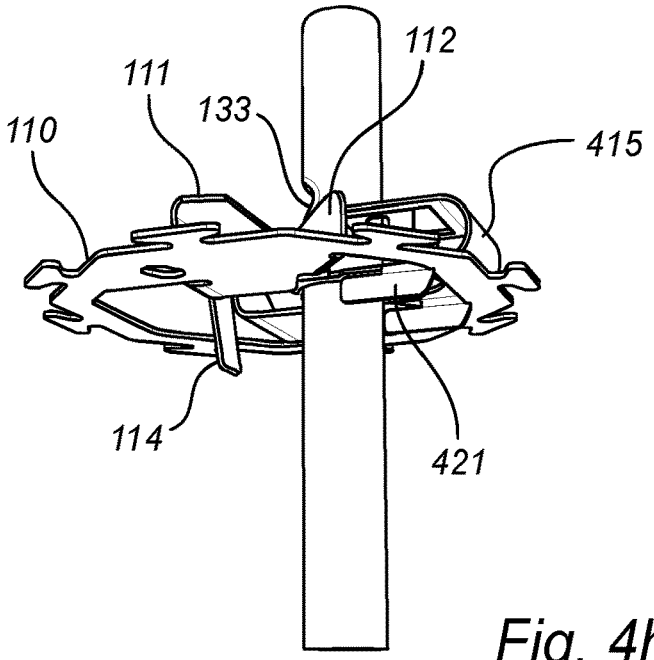
Figure 4I:
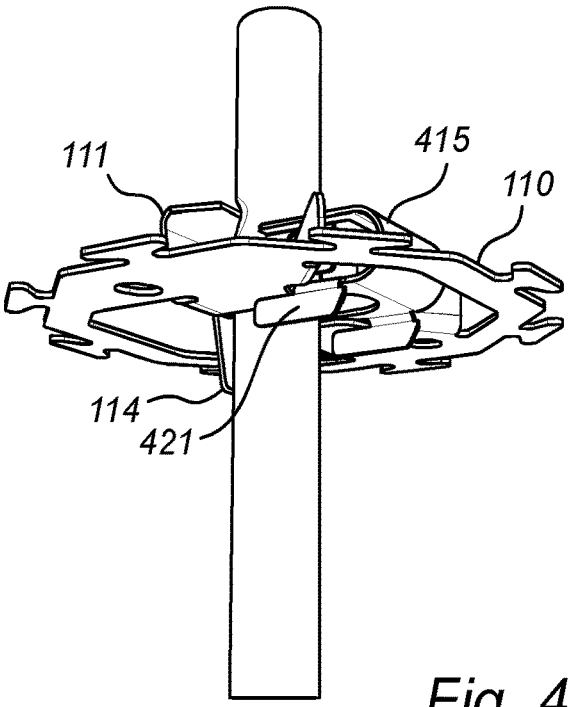
Figure 4J:
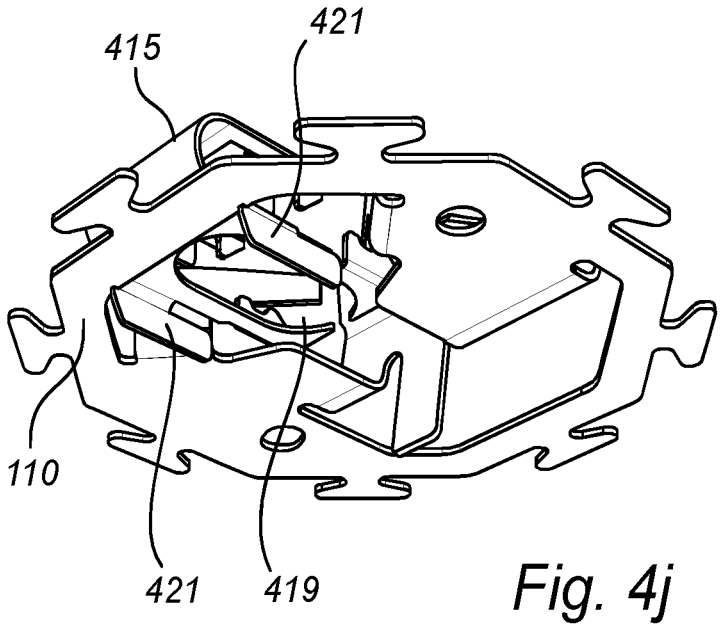
Figure 4K:
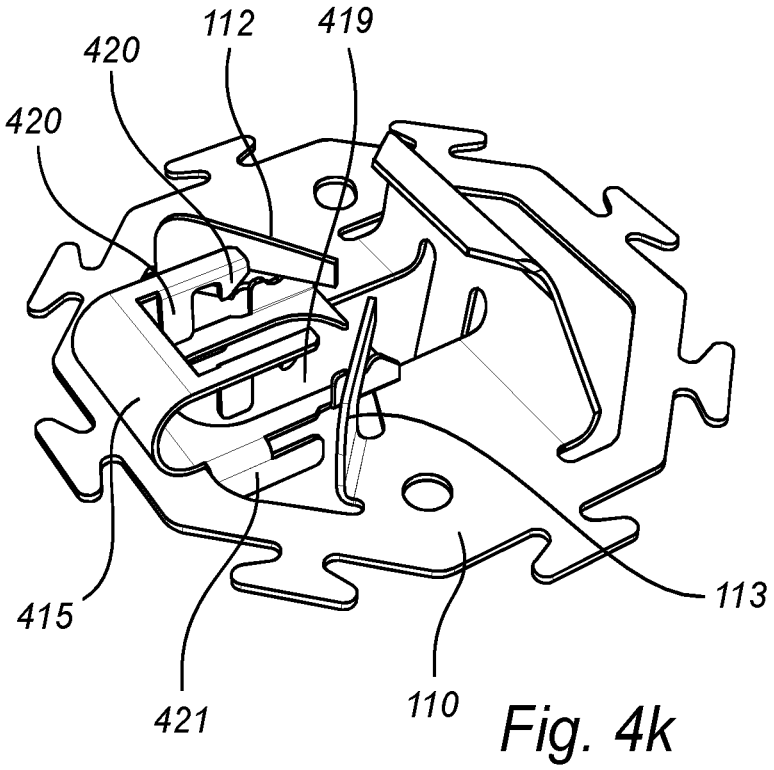

FIG. 4*a* is a perspective view of a locking mechanism 415 according to another embodiment of the invention. The locking mechanism 415 is U-shaped with first 416 and second 417 parallel sections and an intermediate curved section 418. An opening is formed by a recess 419 in the first and the second sections 416, 417. The first 416 and the second section 417 each comprises two prongs A, B; C, D formed by the recess 419. Note that the second section 417 extends further from the intermediate curved section 418 than the first section 416.

The two prongs A, B of the first section 416 each includes a pair of first locking legs 420, 426. The outermost legs 420 are triangular, whereas the innermost legs 426 are rectangular. The triangular legs 420 force the first section 416 to deflect and slide over the finger elements 112, 113 when the locking mechanism 415 is moved radially inwards relative to the mechanical fastening part, and the finger elements 112,113 are received between the triangular legs 420 and the rectangular legs 426.

The two prongs C, D of the second section 417 each further comprises a skid-shaped member 421 adapted to secure the locking mechanism 415 to the mechanical fastening part 110. The skid shaped member 421 together with the second section 417 forms a first recess 423 which secures the locking mechanism 415 to the mechanical fastening part 110 in an assembled position, and a second recess 424 which secures the locking mechanism 415 to the mechanical fastening part 110 in a pre-assembled position. The function of the first and second recess 423, 424 will be further elucidated in the following. Further, each prong C, D of the second section 417 comprises a snap feature 422 located at the free end of the prong and adapted to secure the locking mechanism 415 to the mechanical fastening part 110. Moreover, each prong of the second section 417 comprises a hook feature 425 extending towards the other prong of the second section 417. The hook features 425 force the locking mechanism 415 to follow radial movement of the stem 130.

FIGS. 4*b-k* shows perspective, side and top views of a mechanical fastening part 110, the pump tube portion 132 of the stem 130, where the locking mechanism 415 is pre-assembled to the mechanical fastening part 110.

FIGS. 4*b*, 4*d*, 4*f*, 4*h*, and 4*j* shows the mechanical fastening part 110, the pump tube portion 132 of the stem 130, and the locking mechanism 415 in a pre-assembled position. Note that the locking mechanism 415 and the mechanical fastening part 110 are pre-assembled and secured to each other by the second recess 424 and the snap features 422 of each prong of the second section 417. The second recess 424 is adapted to receive a portion of the mechanical fastening part 110. The snap features 422 of each prong of the second section 417 receive and abuts the two finger elements 112, 113 of the mechanical fastening part 110. Note that the snap features 422 of each prong of the second section 417 comprise two ridges with a lower portion in between, and that it is the lower portion which receives the finger elements 112, 113. The ridges of the snap features thereby force the finger element 112, 113 to deflect when moving the locking mechanism 415 radially and thus creates a small predetermined amount of force to overcome when the locking mechanism 415 is moved radially. In other words, the locking mechanism 415 can be seen as being pre-assembled in a position radially outwards of the mechanical fastening part 110, and being secured to the mechanical fastening part by the second recess 424 and the snap features 422 of each prong of the second section 417.

In order to lock the mechanical fastening part 110 to the stem 130, the stem 130 may be inserted through the mechanical fastening part 110 and the recess of the locking mechanism 415, eccentrically to the final position of the stem 130. The final position for the stem 130 is the center of the mechanical fastening part 110 where the indent 133 of the stem 130 mates with the hook element 111 of the mechanical fastening part 110 and the finger element 112, 113 abut the stem 130. The stem is then moved in direction towards the center of the mechanical fastening part 110, and the hook features 425 of the two prongs of the second section 417 forces the locking mechanism 415 to follow the movement of the stem 130. As the locking mechanism 415 follows the movement of the stem 130, the snap features 422 releases the two finger element 112, 113, and the triangular first locking legs 420 forces the first section 416 to deflect to allow the triangular first locking legs 420 to pass the finger elements 112, 113. The two finger elements 112, 113 are received between the triangular first locking legs 420 and the rectangular first locking legs 426 which thus prevent the finger elements 112, 113 from deflecting in two directions. Further, the first recess 423 receives a portion of the mechanical fastening part 110. The locking mechanism 415 is thereby snapped onto the mechanical fastening part 110.

FIGS. 4*c*, 4*e*, 4*g*, 4*i* and 4*k* shows the mechanical fastening part 110, the pump tube portion 132 of the stem 130, and the locking mechanism 415 with the stem 130 in the final position at the center of the mechanical fastening part 110. The first recess 423 together with the first locking legs 420, 426 of each prong of the first section 416 axially secures the locking mechanism 415 to the mechanical fastening part 110. The two finger elements 112, 113 abuts against the stem 130 and secures the stem 130 in place at the center position of the mechanical fastening part 110.

A method for manufacturing a lighting device 1 according to the invention comprises locking the mechanical fastening part 110 to the stem 130 using the locking mechanism 215, 315, 415. When using a locking mechanism according to the embodiments shown in FIG. 2*a-d* or 3*a-d*, the method further comprises mounting the mechanical fastening 110 part radially to the stem. Locking the mechanical fastening part 110 to the stem using the locking mechanisms 215, 315 comprises placing the locking mechanism 215, 315 axially onto the mechanical fastening part 110.

When using a locking according to the embodiment shown in FIG. 4*a-k*, the method comprises mounting the locking mechanism 415 to the mechanical fastening part 110. Locking the mechanical fastening part 110 to the stem 130 using the locking mechanism 415 comprises mounting the mechanical fastening part 110 with the locking mechanism 415 radially to the stem 130.

The skilled person appreciates that additional steps may be included in the manufacturing of a complete lighting device.

The locking mechanisms 315, 415 may be manufactured from a metal sheet which is stamped or cut and folded into the shape of the locking mechanism 315, 415. It should be noted that other alternatives for manufacturing the locking mechanism 315, 415 are of course possible, for example 3D printing the locking mechanism 315, 415, or using other materials such as thermoplastics or other suitable materials which can be formed into the corresponding shape and then be deformed to snap onto the mechanical fastening part 110.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination may not be used to an advantage.

The invention claimed is:

1. A lighting device comprising:

an envelope;

a light generating unit comprising at least one solid state light source;

a stem configured to support the light generating unit inside the envelope, the stem having an indent;

a mechanical fastening part configured to fasten the light generating unit at the stem, the mechanical fastener part having a hook element configured to mate with the indent and at least one finger element arranged to abut against the stem; and a locking mechanism arranged to lock the mechanical fastening part to the stem by preventing deflection of at least one of the hook element and the at least one finger element of the mechanical fastening part.

2. A lighting device according to claim 1, wherein the locking mechanism comprises at least one first locking leg extending substantially parallel to the stem and adapted to prevent the at least one finger element of the mechanical fastening part from deflecting in at least one direction.

3. A lighting device according to claim 1, wherein the locking mechanism comprises at least one second locking leg adapted to prevent the hook element of the mechanical fastening part from un-mating with the indent of the stem.

4. A lighting device according to claim 1 wherein the locking mechanism is snapped onto the mechanical fastening part.

5. A lighting device according to claim 4, wherein the at least one first locking leg comprises a snap feature adapted to snap onto the at least one finger element of the mechanical fastening part, and wherein the locking ring comprises at least one surface situated between the at least one first locking leg and the at least one second locking leg and adapted to abut against the hook element of the mechanical fastening part, to axially secure the locking mechanism to the mechanical fastening part.

6. A method for manufacturing a lighting device according to claim 1, characterized in that, the method comprising:

locking the mechanical fastening part to the stem using the locking mechanism.

7. A method according to claim 6, further comprising mounting the mechanical fastening part radially to the stem, wherein locking the mechanical fastening part to the stem using the locking mechanism comprises placing the locking mechanism onto the mechanical fastening part.

8. A method according to claim 6, further comprising mounting the locking mechanism to the mechanical fastening part, wherein locking the mechanical fastening part to the stem using the locking mechanism comprises mounting the mechanical fastening part with the locking mechanism radially to the stem.

9. A lighting device according claim 1, wherein the locking mechanism comprises an opening that at least partly fits around the stem.

10. A lighting device according to claim 9, wherein the locking mechanism is U-shaped with first and second parallel sections and an intermediate curved section, wherein said opening is formed by a recess in the first and the second sections, wherein the first and the second section each comprises two prongs formed by said recess, and wherein each prong of the first section includes said at least one first locking leg.

11. A lighting device according to claim 10, wherein each prong with the at least one first locking leg further serves to radially snap the locking mechanism onto the mechanical fastening part.

12. A lighting device according to claim 10, wherein each prong of the second section comprises a skid-shaped member adapted to secure the locking mechanism to the mechanical fastening part.

13. A lighting device according to claim 10, wherein each prong of the second section comprises a snap feature adapted to secure the locking mechanism to the mechanical fastening part.

14. A lighting device according to claim 10, wherein each prong of the second section comprises a hook feature extending towards the other prong of the second section.

15. A lighting device according to claim 9, wherein the opening is formed by a circular hole through the locking mechanism, which circular hole fits around the stem.

16. A lighting device according to claim 15, wherein the locking mechanism comprises a ring formed around said circular hole, and wherein said at least one first and second locking legs are distributed about the circumference of the ring.

17. A lighting device according to claim 15, wherein the locking mechanism comprises a central portion including said circular hole, a first portion bent relative to the central portion and including said at least one first locking leg, and a second portion bent relative to the central portion and including said at least one second locking leg in the form of at least one spring adapted to engage with the hook element of the mechanical fastening part for preventing the hook element of the mechanical fastening part from un-mating with the indent of the stem and for snapping the locking mechanism onto the mechanical fastening part.

18. A lighting device according to claim 17, wherein each at least one first locking leg is a pair of first locking legs adapted to prevent the at least one finger element of the mechanical fastening part from deflecting in two directions.

* * * * *